US005665218A

United States Patent [19]

Ashizawa et al.

[11] Patent Number: 5,665,218

[45] Date of Patent: Sep. 9, 1997

[54] METHOD OF PRODUCING AN OXYGEN GENERATING ELECTRODE

[75] Inventors: Koichi Ashizawa, Yokohama; Toshio Horie, Tokyo; Hitoshi Kato, Utsunomiya, all of Japan

[73] Assignee: The Furukawa Electric Co., Ltd., Tokyo, Japan

[21] Appl. No.: 582,667

[22] Filed: Jan. 4, 1996

Related U.S. Application Data

[62] Division of Ser. No. 271,090, Jul. 6, 1994, abandoned.

[30] Foreign Application Priority Data

Jul. 21, 1993 [JP] Japan ..... 5-179654
Apr. 4, 1994 [JP] Japan ..... 6-065889

[51] Int. Cl.[6] ..... C25D 5/00

[52] U.S. Cl. ..... 205/171; 205/176; 205/170

[58] Field of Search ..... 205/171, 176, 205/191, 170, 200

[56] References Cited

U.S. PATENT DOCUMENTS 4,039,400 8/1977 Hayfield ..... 205/171
5,059,297 10/1991 Hirao et al. ..... 204/290 R

FOREIGN PATENT DOCUMENTS 0027051 4/1981 European Pat. Off. ..... 204/290 F
0925080 5/1963 United Kingdom ..... 204/290 F
2239260 6/1991 United Kingdom .

*Primary Examiner*—Kathryn L. Gorgos
*Assistant Examiner*—Alex Noguerola
*Attorney, Agent, or Firm*—Frishauf, Holtz, Goodman, Langer & Chick, P.C.

[57] ABSTRACT

An oxygen generating electrode has a base material with at least a surface thereof made of titanium alone or a titanium alloy, a primary coating formed on the surface of the base material, and a catalyst layer formed on the primary coating and containing an oxide of platinum group element as a main component. The primary coating is composed of a titanium oxide coating and an oxide mixture layer, the titanium oxide coating being made of a titanium oxide only and including a first titanium oxide layer formed by electrolytically oxidizing the surface of the base material and a second titanium oxide layer formed on the first titanium oxide layer by a thermal decomposition method, the oxide mixture layer including at least one layer formed on the titanium oxide coating and consisting of a mixture containing an oxide of an element belonging to a group other than the platinum group, as a main component, and an oxide of a platinum group element.

9 Claims, 1 Drawing Sheet

METHOD OF PRODUCING AN OXYGEN GENERATING ELECTRODE

This application is a Division of application Ser. No. 08/271,090, filed Jul. 6, 1994 now abandoned.

BACKGROUND OF THE INVENTION

1. Field of the Invention

The present invention relates to an oxygen generating electrode for use in the field of electrochemical industry and a method of producing the same, and more particularly, to an insoluble electrode for oxygen generation and a method of producing the same, which electrode has excellent durability when used as an anode for electrolytic processes such as electroplating, electrolytic refining, electrolytic synthesis of organic materials, and protection of cathodes against corrosion.

2. Description of the Related Art

When plating a base material made of, for example, iron, copper, titanium or stainless steel, with zinc, copper or chromium by electrolytic process, the base material is immersed in a plating bath containing zinc sulfate, copper sulfate or chromium sulfate as a main component, with optional addition of sulfuric acid. Besides the base material serving as a cathode, an oxygen generating electrode, which serves as an anode, is immersed in the plating bath so that electrolytic reaction takes place when an electric current is passed between the electrodes.

For the oxygen generating electrode, a lead electrode is conventionally used.

Lead electrodes can be manufactured at low cost, and their solubility to sulfuric acid is low even though the lead dissolves in the plating bath. Accordingly, the concentration of lead in the plating bath can be maintained at a low level, and the plated surface of the base material is less influenced by lead ions.

The lead electrode, however, has a problem when used as the oxygen generating electrode. Namely, the overvoltage during the oxygen generation becomes high, and the distance between the electrodes increases because the lead dissolves as electrolysis progresses, increasing the electrolytic voltage of the bath as a whole. Thus, it is difficult to cut down the power consumption during electrolysis, and adjustment of the interelectrode distance and replacement of electrodes are frequently required since the thickness of the electrode decreases with use.

In place of the lead electrode associated with the above problem, an insoluble electrode coated with a platinum group metal alone or with a platinum group metal oxide is often used as the oxygen generating electrode.

This insoluble electrode usually has a structure wherein a base material, which is made of a valve metal such as titanium or an alloy containing such valve metal as a main component, is coated with an oxide catalyst layer containing, as a main component, a platinum group metal oxide such as iridium oxide or a mixture of iridium oxide and tantalum oxide. This type of insoluble electrode is scarcely consumed during electrolysis, and the oxygen overvoltage is extremely low as compared with the lead electrode.

For example, where an insoluble electrode of this type having a base material made of titanium or an alloy containing titanium as a main component and a catalyst layer made of iridium oxide is used as an anode during the manufacture of electrolytic copper foils, the plating cell voltage can be lowered by approximately 1 V, compared with the case of using the conventional lead electrode, thus making it possible to greatly cut down the power consumption during electrolysis. Further, since the electrode is scarcely consumed during the electrolytic process, the interelectrode distance remains substantially the same. Accordingly, this type of electrode serves to stabilize the processing conditions, as well as the quality of products.

Although the oxygen generating electrode having the catalyst layer containing an iridium oxide as a main component has the above-described advantages, it is still associated with a problem in that the electrolytic voltage suddenly rises after the electrolytic process is continued for a certain period of time. This phenomenon is conspicuous particularly in cases where the electrolysis is carried out at high current density. In general, when such phenomenon occurs, it is judged that the service life of the oxygen generating electrode has expired.

The above phenomenon is presumably caused by oxidation of the surface of the base material due to penetration of oxidizing substances, produced on the surface of the electrode (the surface of the catalyst layer) during electrolysis, or sulfuric acid component in the plating bath through to the surface of the base material located inward of the catalyst layer. If the surface of the base material is oxidized, the adhesion between the base material and the catalyst layer lowers or an electrical insulating oxide film is formed on the surface of the base material, lowering the electrical conductivity of the oxygen generating electrode as a whole and finally raising the electrolytic voltage.

Consequently, even though the insoluble electrode for oxygen generation shows excellent properties at an initial stage, the aforementioned phenomenon can occur, depending on the electrolysis conditions, and the service life of the electrode shortens.

To solve the problem, there have been proposed electrodes in which a primary coating consisting of a material having excellent corrosion resistance is formed on the surface of the base material prior to the formation of the catalyst layer.

For example, Examined Japanese Patent Publication (KOKOKU) No. 49-48072 discloses a method in which electrolytic or chemical oxidizing process is performed on a base material in an aqueous solution in which a valve metal, such as Ti, Ta, Nb or Zr, is dissolved, to cause an oxide of the valve metal to deposit on the surface of the base material, the resulting thin oxide layer serving as the primary coating. Then, a catalyst layer consisting of a platinum group metal or an oxide of such platinum group metal is formed on the surface of the primary coating.

The electrode produced by this method, however, has poor adhesion at interface between the primary coating and the catalyst layer. Thus, when the electrode is used as an oxygen generating electrode, the primary coating and the catalyst layer are gradually separated from each other at the interface thereof due to the effect of oxidizing substances produced on the electrode surface, and the electrode finally fails to retain its advantage of excellent durability.

Unexamined Japanese Patent Publication (KOKAI) No. 57-116786 discloses a method in which a base material is immersed in an aqueous solution in which a metal, such as Ti, Ta, Zr, Hf or Nb, is dissolved, a layer consisting of an oxide of the metal is formed on the surface of the base material by electrodeposition, as in the method disclosed in Examined Japanese Patent Publication No. 49-48072, and part of the oxide layer is subjected to heat treatment in a non-oxidizing atmosphere.

This method permits a primary coating of relatively large thickness to be formed between the base material and the catalyst layer. However, the base material and the primary coating produced by this method have poor adhesion.

Examined Japanese Patent Publication No. 60-21232 discloses a method in which a Ta compound or/and a Nb compound are thermally decomposed on the surface of a base material consisting of Ti or a Ti alloy, so that a Ti oxide present on the surface of the base material in the form of a thin film is mixed with the Ta or/and Nb oxide, thereby forming a primary coating consisting of mixed oxides.

However, the primary coating consisting of mixed oxides has poor adhesion with the base material and is also poor in corrosion resistance. Thus, the electrode produced by this method, fails to withstand long use.

In Examined Japanese Patent Publication No. 60-22074 is proposed an electrode in which a thin primary coating consisting of a mixture of Ti and/or Sn oxide and Ta and/or Nb oxide is formed on the surface of a base material by a thermal decomposition method.

In this electrode, however, although the primary coating has some degree of electrical conductivity, the corrosion resistance is poor because the primary coating is made of mixed oxides. Accordingly, the surface of the base material becomes passive with use, and a long service life cannot be expected.

In Examined Japanese Patent Publication No. 3-27635 and Unexamined Japanese Patent Publication No. 2-61083 are disclosed electrodes wherein a primary coating consisting of a mixture of an iridium oxide and an oxide of at least one substance selected from the group consisting of Ta, Ti, Nb, Sn and Zr is formed between a base material and a catalyst layer.

The primary coatings disclosed in these publications have good electrical conductivity, but since they are made of mixed oxides, the corrosion resistance is low, as in the case of the aforementioned electrodes. Thus, these electrodes do not have a long service life.

European Patent Publication No. 0538955 (A1) discloses an electrode comprising a base material made of Ti, Ta, Nb, Zr or Hf, a primary coating formed on the surface of the base material by a thermal decomposition method, and a catalyst layer formed on the primary coating and containing an iridium oxide. The primary coating is obtained by successively forming on the base material a layer of a Ti or Sn oxide, and a layer of a mixture of a Ta oxide and an Ir, Co or Pb oxide, or by successively forming on the base material a layer of a mixture of a Ta oxide and an Ir, Co or Pb oxide, and a layer of a Ti or Sn oxide.

This electrode also does not have sufficient adhesion between the base material and the Ti or Sn oxide layer, and is unable to ensure a long service life.

OBJECTS AND SUMMARY OF THE INVENTION

An object of the present invention is to provide an oxygen generating electrode and a method of producing the same, which electrode has a primary coating with excellent corrosion resistance formed between a base material and a catalyst layer and which ensures good adhesion at the interface between the base material and the primary coating and between the primary coating and the catalyst layer.

Another object of the present invention is to provide an oxygen generating electrode and a method of producing the same, which electrode withstands a long-term use while at the same time maintaining a low oxygen overvoltage even under high current-density conditions.

To achieve the above objects, according to a first aspect of the present invention, there is provided an oxygen generating electrode (hereinafter referred to as the first electrode) comprising:

a base material having at least a surface thereof made of titanium alone or a titanium alloy; and a primary coating interposed between the base material and a catalyst layer containing an oxide of a platinum group element as a main component, the primary coating being composed of a titanium oxide coating and an oxide mixture layer, the titanium oxide coating being made of a titanium oxide only and including a first titanium oxide layer formed by electrolytically oxidizing the surface of the base material and a second titanium oxide layer formed on the first titanium oxide layer by a thermal decomposition method, the oxide mixture layer including at least one layer formed on the titanium oxide coating and consisting of a mixture containing an oxide of an element belonging to a group other than the platinum group, as a main component, and an oxide of a platinum group element.

According to a second aspect of the present invention, there is provided an oxygen generating electrode (hereinafter referred to as the second electrode) comprising:

a base material having at least a surface thereof made of titanium alone or a titanium alloy; and a primary coating interposed between the base material and a catalyst layer containing an oxide of a platinum group element as a main component, the primary coating being composed of a titanium oxide coating and an oxide layer, the titanium oxide coating being made of a titanium oxide only and including a first titanium oxide layer formed by electrolytically oxidizing the surface of the base material and a second titanium oxide layer formed on the first titanium oxide layer by a thermal decomposition method, and the oxide layer being formed on the titanium oxide coating and consisting of an oxide of an element belonging to a group other than the platinum group.

According to a third aspect of the present invention, an oxygen generating electrode (hereinafter referred to as the third electrode) is provided which comprises:

a base material having at least a surface thereof made of titanium alone or a titanium alloy; and a primary coating interposed between the base material and a catalyst layer containing an oxide of a platinum group element as a main component, the primary coating being composed of a titanium oxide coating, an oxide layer and an oxide mixture layer, the titanium oxide coating being made of a titanium oxide only and including a first titanium oxide layer formed by electrolytically oxidizing the surface of the base material and a second titanium oxide layer formed on the first titanium oxide layer by a thermal decomposition method, the oxide layer being formed on the titanium oxide coating and consisting of an oxide of an element belonging to a group other than the platinum group and the oxide mixture layer including at least one layer formed on the oxide layer and consisting of a mixture containing an oxide of an element belonging to a group other than the platinum group, as a main component, and an oxide of a platinum group element.

When producing the first, second or third electrode according to the method of the present invention, the base material, the surface of which has been cleaned, is immersed in an electrolyte, and then an electrolytic oxidation process is carried out using a quantity of electricity of 3 mAh/cm$^2$ or less at a potential of 0.5 to 15 V with respect to the normal hydrogen electrode potential, thereby forming a titanium oxide layer (the first titanium oxide layer) having a thickness of 1 to 20 nm on the surface of the base material. Subsequently, a titanium compound is applied to the titanium oxide layer and then thermally decomposed at a temperature of 400° to 600° C. in an oxygen-containing atmosphere, to thereby form an additional titanium oxide layer (the second titanium oxide layer).

DETAILED DESCRIPTION OF THE PREFERRED EMBODIMENTS

Figure 1:
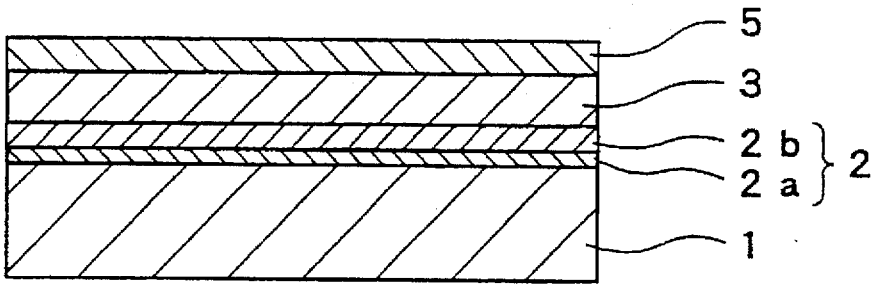
FIG. 1 is a sectional view illustrating the layer structure of a first electrode.

First, second and third electrodes according to the present invention each have a structure wherein a primary coating, described later, is interposed between a base material and a catalyst layer.

The base material 1 used in the first, second and third electrodes of the present invention has at least a surface thereof made of Ti alone or a Ti alloy. Namely, the base material 1 may in its entirety consist of Ti or a Ti alloy, or may comprise a core made of a stainless steel, for example, the surface of which is coated with Ti or a Ti alloy by a layer formation method such as a lamination method, PVD method or CVD method.

Titanium used may be Ti of either the first kind or the second kind as provided by JIS H 4600. The Ti alloy used may be a 6% Al-4% V—Ti alloy or a 15% Mo-5% Zr-3% Al—Ti alloy.

The shape of the base material 1 is not particularly limited; the base material 1 may have a shape suitable for use as an electrode and be in the form of a plate, rod, or lath, for example. Usually, the base material 1 is plate-shaped.

In the first, second and third electrodes, a coating 2 consisting of titanium oxide alone is formed directly on the surface of the base material 1, which surface consists of Ti alone or the Ti alloy. The titanium oxide coating 2 is composed of a titanium oxide layer **2*a* formed by electrolytic oxidation and a titanium oxide layer 2*b* formed by thermally decomposing a titanium compound, and the titanium oxide layers 2*a* and 2*b* being successively formed on the base material 1** in the order named.

Prior to the formation of the titanium oxide coating 2, it is necessary that a titanium oxide skin film formed on the surface of the base material 1 while the base material 1 is produced or is left in the air should be removed. If the titanium oxide coating 2 is formed without the titanium oxide skin film being removed, the adhesion between the titanium oxide coating 2 and the base material lowers.

Preferably, the cleaned surface of the base material, from which the titanium oxide skin film has been removed, is subjected to surface roughening so as to obtain a surface roughness Rz as provided by JIS B0601 of 5 to 100 μm, more preferably, 10 to 40 μm, whereby the adhesion strength between the base material and the titanium oxide coating 2, the adhesion strength between the titanium oxide coating 2 and an oxide mixture layer or oxide layer, mentioned later, and the adhesion strength between a catalyst layer and the oxide mixture layer or oxide layer can be advantageously increased.

The removal of the titanium oxide skin film from the surface of the base material and the toughening of the cleaned surface of the base material can be carried out as follows: For example, the base material is immersed in an aqueous solution of oxalic acid having an oxalic acid concentration of 5 to 40% by weight and a liquid temperature of 50° C. to 100° C., preferably 90 to 100, for about one to eight hours. Alternatively, the base material is immersed in an aqueous solution of sulfuric acid having a sulfuric acid concentration of 5 to 50%, and using the base material as an anode, the base material is etched at a current density of 5 to 30 A/dm$^2$ for about one to 10 minutes.

After the titanium oxide skin film is removed from the surface of the base material and the toughening process is carried out as mentioned above, a very thin layer of a titanium oxide having excellent adhesion with the base material is formed by electrolytically oxidizing the surface of the base material, and then another layer of a titanium oxide is formed by applying a solution of a titanium compound to the very thin titanium oxide layer and thermally decomposing the compound in an oxygen-containing atmosphere, thereby forming the titanium oxide coating 2.

The titanium oxide layer **2*a* is formed by electrolytically oxidizing the surface of the base material to a depth of 1 to 20 nm. By electrolytically oxidizing the surface region of the base material to the depth mentioned, the titanium at the surface of the base material is converted to a titanium oxide while maintaining the titanium structure, i.e., oxide structure including the epitaxial structure, whereby the adhesion between the titanium oxide layer 2*a*** and the base material is extremely high.

If the thickness of the titanium oxide layer **2*a* is greater than 20 nm, the adhesion with the base material and also the denseness of the layer 2*a* lowers, and thus the produced electrode becomes deteriorated in Corrosion resistance. On the other hand, if the thickness of the layer 2*a* is smaller than 1 nm, the layer 2*a* itself does not have a sufficient corrosion resistance. Accordingly, the preferred thickness of the titanium oxide layer 2*a*** is 2 to 5 nm.

The titanium oxide layer **2*a*** is formed by first immersing the base material in (a) an aqueous solution of an inorganic acid such as sulfuric acid, nitric acid or phosphoric acid, or (b) an aqueous solution of an inorganic salt such as sodium sulfate or potassium sulfate, or (c) an aqueous solution of an inorganic alkali such as sodium hydroxide or potassium hydroxide; and then using the base material as an anode and platinum, for example, as a cathode, electrolytic oxidation is carried out with a quantity of electricity of 3 mAh/cm$^2$ or less passed between the two electrodes at a potential of 0.5 to 15 V, preferably 1.5 to 3 V, with respect to the normal hydrogen electrode potential.

The titanium oxide layer **2*a* produced by the electrolytic oxidation has excellent adhesion with the base material, but since the thickness thereof is very small, the layer 2*a* does not exhibit sufficient corrosion resistance by itself. Accordingly, a thick titanium oxide layer 2*b* is formed over the layer 2*a*** by a thermal decomposition method.

This titanium oxide layer **2*b* is formed on the first coating the aforesaid titanium oxide layer 2*a*** with a solution which is prepared by dissolving a titanium compound, for example, in a specific solvent, and then thermally decomposing the coating in an oxygen-containing atmosphere at a temperature of 400° to 650° C.

The titanium oxide layer **2*b*** formed by the thermal decomposition method usually has a non-stoichiometric composition indicated by $TiO_{2-x}$ ($0<x<0.5$), though the composition varies depending on the heating temperature and the oxygen concentration of the atmosphere, and has electrical conductivity.

The titanium oxide layer **2*b* having the above non-stoichiometric composition can be obtained, for example, by dissolving titanium tetra-n-butoxide in n-butyl alcohol, applying the solution thus prepared directly to the surface of the titanium oxide layer 2*a* with a brush or spray, drying the resulting coating at a temperature of about 120° C., and heating the entire structure in the air at a temperature of 400° to 650° C., preferably 440° to 500° C., for 5 to 60 minutes, preferably 10 to 20 minutes, to thereby thermally decompose the coating. The titanium oxide layer 2*b*** formed under these conditions has an electrical conductivity of 0.1 to 10 mS/cm, which is sufficient for use as an electrode.

The service life of the electrode can be sufficiently prolonged if the operation from the solution application step to the thermal decomposition step is performed only once during the formation of the titanium oxide layer 2b, but the operation may be repeated a plurality of times. Preferably, the thickness of the titanium oxide layer 2b is 0.1 to 5 μm, more preferably 0.5 to 2 μm. If the thickness of the layer 2b is smaller than 0.1 μm, the corrosion resistance of the electrode is insufficient for actual use, and if the thickness is greater than 5 μm, required electrical conductivity is not obtained.

In the first, second and third electrodes, the titanium oxide coating 2 composed of the titanium oxide layers 2a and 2b is formed on the surface of the base material 1.

Since the layers 2a and 2b are each made of a titanium oxide alone, the affinity and adhesion strength between these layers are high. Further, the titanium oxide layer 2a is formed by converting the surface of the base material to an oxide through electrolytic oxidation, and accordingly, the adhesion strength between the layer 2a and the base material is also high. Consequently, the titanium oxide coating 2 as a whole has remarkable adhesion with the base material.

The titanium oxide coating 2 consists of titanium oxide alone, and not mixed oxides, and thus has excellent corrosion resistance.

In the first electrode, an oxide mixture layer 3 is formed on the titanium oxide layer 2b, as shown in FIG. 1. The oxide mixture layer 3 consists of a mixture containing, as a main component, (A) an oxide of an element not belonging to the platinum group, such as Ta, Nb, Sn or W, and (B) an oxide of a platinum group metal such as Ru, Rh, Pd, Os, Ir or Pt.

The primary coating is composed of the titanium oxide coating 2 and the oxide mixture layer 3 formed thereon.

Of the mixed oxides, the former oxide (A) serves to enhance the denseness of the oxide mixture layer 3 produced, and also serves as an intermediate layer for increasing the adhesion between the titanium oxide coating 2 and the catalyst layer, described later. The latter oxide (B) serve to impart electrical conductivity to the entire layer while maintaining the denseness of the oxide mixture layer 3.

It is necessary that the oxide mixture layer 3 should contain the oxide (A) as a main component. Specifically, the ratio of the oxide (A) to the oxide (B) should preferably be 50 to 95 mole %, more preferably 70 to 85 mole %, in terms of metal-reduced chemical equivalent.

If the mixing ratio of the oxide (A) to the oxide (B) in terms of metal-reduced chemical equivalent is smaller than 50 mole %, the denseness of the oxide mixture layer 3 and also the adhesion with the titanium oxide coating 2 lower. Thus, when the electrode is actually used, an electrolyte or oxidizing substances are likely to penetrate into the surface of the base material, shortening the service life. If the mixing ratio of the oxide (A) to the oxide (B) in terms of metal-reduced chemical equivalent is greater than 95 mole %, the electrical conductivity of the oxide mixture layer 3 lowers, and the electrode fails to properly function as an oxygen generating electrode. For the oxide (A), an oxide of Ta is preferred because it has excellent corrosion resistance and good affinity with a titanium oxide and can enhance the denseness of the oxide mixture layer 3. For the oxide (B), an oxide of Ir is preferred not only because it imparts electrical conductivity to the oxide mixture layer 3 but also because it serves to increase the adhesion with the catalyst layer, mentioned later.

Preferably, the thickness of the oxide mixture layer 3 is 0.1 to 10 μm, more preferably 1 to 5 μm. If the thickness of the layer 3 is smaller than 0.1 μm, it is difficult to effectively prevent the electrolyte or oxidizing substances from penetrating into the surface of the base material when the electrode is in actual use. If the thickness of the layer 3 is increased beyond 10 μm, the effects become saturated, uselessly wasting the material for the formation of the layer.

The oxide mixture layer 3 can be formed by the aforementioned thermal decomposition method. Specifically, a compound of an element belonging to a group other than the platinum group and a compound of a platinum group element are dissolved at a suitable ratio in a solvent, the solution thus prepared is coated on the titanium oxide layer 2b, and the coating is thermally decomposed in an oxygen-containing atmosphere. The proportions of the compounds used are determined by the ratio of the oxides in the oxide mixture layer 3 to be formed.

For example, in the case of forming an oxide mixture layer 3 consisting of a Ta oxide and an Ir oxide, tantalum chloride or tantalum penta-n-butoxide and chloroiridic acid hexahydrate are dissolved in n-butyl alcohol, the solution thus prepared is coated on the surface of the titanium oxide layer 2b and then dried at a temperature of about 120° C., and the entire structure is heated in the air at a temperature of 400° to 650° C., preferably 440° to 550° C., for 5 to 60 minutes, preferably 10 to 20 minutes, to thereby thermally decompose the coating.

The oxide mixture layer 3 may be of a single layer structure, or a multi-layer structure obtained by repeating the operation from the solution application step to the thermal decomposition step a plurality of times.

Figure 2:
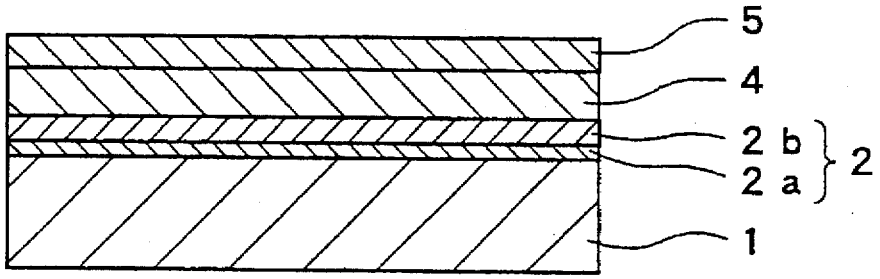
FIG. 2 is a sectional view illustrating the layer structure of a second electrode.

In the second electrode of the present invention, a layer 4 consisting of an oxide of an element belonging to a group other than the platinum group is formed on the titanium oxide layer 2b, as shown in FIG. 2. Namely, the primary coating is composed of the titanium oxide coating 2 and the oxide layer 4 formed thereon.

The oxide constituting the layer 4 may be of any oxide of a single substance as far as it has excellent durability and belongs to a group other than the platinum group, for example, a Ta oxide, Nb oxide, W oxide, or Sn oxide. Among these oxides, a Ta oxide is preferred.

The oxide layer 4 itself has high denseness and high strength and is excellent in corrosion resistance; therefore, it serves to prevent the electrolyte or oxidizing substances from penetrating into the surface of the base material when the electrode is in actual use. Particularly in the case where the oxide layer 4 consists of a Ta oxide, the layer 4 has the advantage of increasing the adhesion with the titanium oxide coating 2, as well as the adhesion with the catalyst layer, mentioned later, in addition to the above function.

The thickness of the oxide layer 4 is preferably 0.01 to 10 μm. If the thickness of the layer 4 is smaller than 0.01 μm, the aforesaid effects are not fully obtained, and if the thickness of the layer 4 is greater than 10 μm, the adhesion between the layer 4 and the titanium oxide coating 2 lowers. The preferred thickness of the layer 4 is 0.02 to 1.0 μm.

The oxide layer 4 can be formed by the thermal decomposition method described above.

For example, in the case of forming a Ta oxide layer, a solution is prepared by dissolving tantalum chloride in n-butyl alcohol or dissolving tantalum penta-n-butoxide in n-butyl alcohol, the solution thus prepared is coated on the surface of the titanium oxide layer 2b, and then the coating is dried at a temperature of about 120° C.

Subsequently, the entire structure is heated in the air at a temperature of 400° to 650° C., preferably 440° to 550° C., for 5 to 60 minutes, preferably 10 to 20 minutes, to thereby thermally decompose the coating.. As a result, a tantalum oxide film as the oxide layer 4 is formed on the titanium oxide layer 2b.

The service life of the electrode can be sufficiently prolonged if the operation from the solution application step to the thermal decomposition step is performed only once during the formation of the oxide layer 4 by the thermal decomposition method, but the operation may be repeated a plurality of times.

Figure 3:
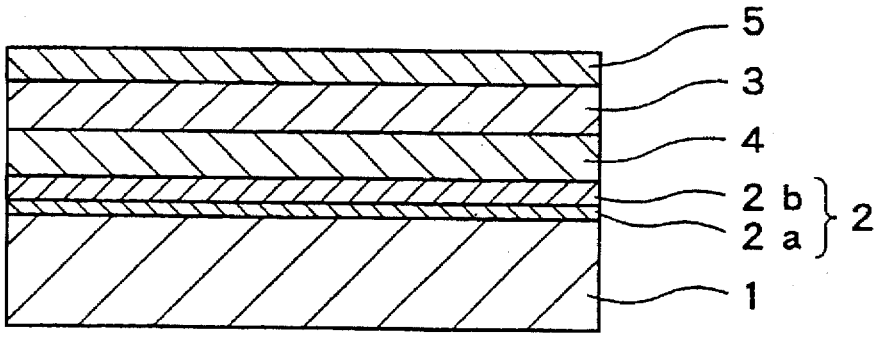
FIG. 3 is a sectional view illustrating the layer structure of a third electrode.

In the third electrode, the oxide layer 4 and the oxide mixture layer 3 are formed on the titanium oxide layer 2b in the order mentioned, as shown in FIG. 3. Namely, the primary coating is composed of the titanium oxide coating 2, the oxide layer 4, and the oxide mixture layer 3.

In this third electrode, the functions of the individual layers forming the primary coatings of the first and second electrodes are effectively combined, and thus the electrode has extremely high corrosion resistance.

In the first, second and third electrodes, the catalyst layer 5 is formed over the primary coating, as shown in FIGS. 1 to 3.

The catalyst layer 5 contains, as a main component, an oxide of a platinum group metal such as Ru, Rh, Pd, Os, Ir or Pt.

As an oxide of an element other than the platinum group metals, a Ta oxide, Nb oxide, W oxide or Sn oxide, for example, can be used.

Preferably, the catalyst layer 5 consists of a mixture of an Ir oxide, as a main component, and a Ta oxide.

In this case, the content of the Ir oxide is preferably 50 to 95 mole %, more preferably 55 to 65 mole %, in terms of Ir (metal)-reduced chemical equivalent.

If the mixing ratio of the Ir oxide is smaller than 50 mole % in terms of Ir (metal)-reduced chemical equivalent, the catalytic activity of the catalyst layer lowers. If, on the other hand, the mixing ratio of the Ir oxide is greater than 95 mole %, the denseness of the catalyst layer 5 lowers, deteriorating the corrosion resistance of the electrode as a whole.

The thickness of the catalyst layer 5 is not particularly limited. However, if the layer 5 is too thin, the required function is not fully achieved; if the layer 5 is too thick, its effect becomes saturated, uselessly increasing the manufacturing cost. Usually, the thickness of the catalyst layer 5 is about 3 to 30 μm.

In the case of forming a catalyst layer 5 consisting of a mixture of an Ir oxide as a main component and a Ta oxide, for example, chloroiridic acid hexahydrate and tantalum penta-n-butoxide are dissolved at a desired ratio in n-butyl alcohol, and the solution thus prepared is applied to the surface of the primary coating and then dried at a temperature of about 120° C. Subsequently, the entire structure is heated in the air at a temperature of 400° to 550° C., preferably 440° to 520° C., for 5 to 60 minutes, preferably 10 to 20 minutes, to thereby thermally decompose the dried layer.

The operation from the solution application step to the thermal decomposition step is repeated several to several tens of times, to thereby obtain an oxide mixture layer or catalyst layer 5 of a desired thickness on the primary coating.

The following is a description of the functions of the individual layers forming the first electrode (FIG. 1), among the first to third electrodes, wherein the oxide mixture layer 3 consists of a mixture of a Ta oxide and an Ir oxide and the catalyst layer 5 consists of a mixture of an Ir oxide and a Ta oxide.

First, since the titanium oxide coating 2 is composed only of the Ti oxide layer 2a formed by electrolytic oxidation and the Ti oxide layer 2b having non-stoichiometric composition, it has sufficient electrical conductivity for use as an electrode and also has good corrosion resistance. Accordingly, even if the electrolyte or oxidizing substances penetrate from the electrode surface when the electrode is in actual use, the titanium oxide coating 2 is scarcely corroded by the electrolyte or oxidizing substances.

The titanium oxide layer 2a is formed by converting the surface of the base material to an oxide, and thus, the adhesion strength between the layer 2a and the base material is high. Further, since the layer 2b formed on the layer 2a also consists of a titanium oxide, the affinity and adhesion between the layers 2a and 2b are excellent. Accordingly, the titanium oxide coating 2 as a whole has good adhesion with the base material.

The oxide mixture layer 3 consists of a metal oxide which has good adhesion with the titanium oxide coating and an oxide of a catalytic metal which constitutes the catalyst layer and which improves the adhesion with the catalyst layer 5. Where the oxide mixture layer 3 consists of a Ta oxide and an Ir oxide, the layer 3 itself has excellent corrosion resistance and high denseness, and when interposed between the titanium oxide coating 2 and the catalyst layer 5 containing an Ir oxide as a main component, the layer 3 provides strong adhesion between these layers.

Accordingly, the oxide mixture layer 3 prevents the penetration of the electrolyte or oxidizing substances from the electrode surface when the electrode is in actual use, whereby situations are avoided wherein the surface of the base material is passivated by the electrolyte or oxidizing substances, making the current passage impossible. Namely, the service life of the electrode is prolonged.

Thus, in the first electrode, the titanium oxide coating 2 and oxide mixture layer 3 having the above-described functions are interposed between the base material 1 and the catalyst layer 5; therefore, when the electrode is in actual use, separation of the layers at their interface and the situation -where the surface of the base material is passivated by oxidizing substances from the electrode surface can be effectively prevented. Accordingly, the electrode has a long service life when used as an oxygen generating electrode.

EXAMPLES 1 AND 2 AND CONTROLS 1 TO 10

The first electrodes were produced in the following manner:

Plates of the second kind of Ti according to JIS H 4600 each having a length of 200 mm, a width of 20 mm and a thickness of 2 mm were degreased and cleaned in acetone, and then dried. Subsequently, the Ti plates were immersed in a solution of oxalic acid (liquid temperature: 90° C.) having an oxalic acid concentration of 10% by weight, for time periods respectively shown in Table 1-1 and Table 1-2 for surface roughening, then washed in water and dried. The Ti plates had surface roughnesses Rz shown in Table 1-1 and Table 1-2, according to JIS B0601.

In the surface roughening step, the Ti plates of Controls 2 and 3 were physically sandblasted using an alumina abrasives having an average particle size of 300 μm.

Then, using each Ti plate as an anode and a platinum plate as a cathode, electrolytic oxidation was carried out in a solution of sulfuric acid (liquid temperature: 30° C.), as an electrolyte, having a sulfuric acid concentration of 1 mole % under the conditions shown in Table 1-1 and Table 1-2, thereby forming titanium oxide layers 2a having thicknesses shown in Table 1-1 and Table 1-2.

One hundred ml of solution was prepared by dissolving 34.0 g of titanium tetra-n-butoxide in n-butyl alcohol.

Using a brush, the solution was applied to the titanium oxide layer 2a formed on the surface of each Ti plate, and the solution applied was dried at a temperature of 120° C. for three minutes and then further heated in the air at a temperature of 450° C. for 10 minutes, thereby forming a titanium oxide layer 2b having a thickness of about 1 μm.

Subsequently, 100 ml of solution was prepared by dissolving 17.4 g of tantalum penta-n-butoxide and 4.1 g of chloroiridic acid hexahydrate in n-butyl alcohol. The solution was applied to the surface of each Ti oxide layer 2b with a brush, and the solution applied was dried at a temperature of 120° C. for three minutes and then further heated in the air at a temperature of 450° C. for 10 minutes, thereby obtaining oxide mixture layers 3 having thicknesses shown in Table 1-1 and Table 1-2 and each consisting of a mixture of Ta oxide and Ir oxide.

For Control 8, a 100-ml solution prepared by dissolving 2.2 g of tantalum penta-n-butoxide and 18.4 g of chloroiridic acid hexahydrate in n-butyl alcohol was used to form the oxide mixture layer 3. In the case of Control 9, a 100-ml solution prepared by dissolving 6.5 g of tantalum penta-n-butoxide and 14.4 g of chloroiridic acid hexahydrate in n-butyl alcohol was used to form the oxide mixture layer 3. Further, in the case of Control 10, a 100-ml solution prepared by dissolving 21.3 g of tantalum penta-n-butoxide and 0.4 g of chloroiridic acid hexahydrate in n-butyl alcohol was used to form the oxide mixture layer 3.

The ratio at which the Ta oxide was contained in each of the oxide mixture layers 3, measured in terms of Ta (metal) -reduced chemical equivalent, is shown in Table 1-1 and Table 1-2.

Then, a 100-ml solution for the catalyst layer was prepared by dissolving 12.2 g of chloroiridic acid hexahydrate and 8.7 g of tantalum penta-n-butoxide in n-butyl alcohol.

The solution was applied to the surface of each oxide mixture layer 3 with a brush, and the solution applied was dried at a temperature of 120° C. for three minutes and then further heated in the air at a temperature of 450° C. for 10 minutes, thereby thermally decomposing the substances of the solution to obtain an oxide mixture layer. Then, the operation consisting of the solution application step, the drying step, and the thermal decomposition step was repeated four times, whereby a catalyst layer having a thickness of about 4 μm was obtained. The heating time for the last operation was one hour.

For Control 11, a 100-ml solution prepared by dissolving 2.1 g of chloroiridic acid hexahydrate and 18.2 g of tantalum penta-n-butoxide in n-butyl alcohol was used to form the catalyst layer 5. In the case of Control 12, a 100-ml solution prepared by dissolving 6.5 g of chloroiridic acid hexahydrate and 14.1 g of tantalum penta-n-butoxide in n-butyl alcohol was used to form the catalyst layer 5. Further, in the case of Control 13, a 100-ml solution prepared by dissolving 21.0 g of chloroiridic acid hexahydrate and 0.4 g of tantalum penta-n-butoxide in n-butyl alcohol was used to form the catalyst layer 5.

The ratio at which the Ir oxide was contained in each of the catalyst layers 5, measured in terms of Ir (metal)-reduced chemical equivalent, is shown in Table 1-1 and Table 1-2.

Each electrode thus obtained and a platinum plate were immersed in a solution of sulfuric acid (liquid temperature: 100° C.) having a sulfuric acid concentration of 1 mole/l, and using the electrode as an anode and the platinum plate as a cathode, a direct-current voltage was applied between the electrodes at a current density of 100 A/dm$^2$.

When the anode is operating normally, the terminal voltage shows 3 to 5 V. When the anode is deteriorated, however, the anode potential suddenly rises and also the terminal voltage suddenly rises to 10 V or more.

For each of Examples and Controls, the time period from the start of current supply to the point of time at which the terminal voltage exceeded 10 V was measured. The results are shown in Table 1-1 and Table 1-2.

TABLE 1-1

| | Surface roughening | | Titanium oxide coating 2 | | | | Oxide mixture layer 3 | | Catalyst layer 5 | | Time |
|---|---|---|---|---|---|---|---|---|---|---|---|
| | | | Titanium oxide layer 2a | | | Thickness of titanium | | Ta oxide | | Ir oxide | elapsed |
| | Immersion time (hr) | Surface roughness (Rz: μm) | Potential (V) | Quantity of electricity (mAh/cm$^2$) | Thickness (nm) | oxide layer 2b (μm) | Thickness (μm) | content (Ta-reduced chemical equivalent: mole %) | Thickness (μm) | content (Ir-reduced chemical equivalent: mole %) | before voltage rise to 10 V (hr) |
| Example 1 | 5 | 15~20 | 2 | 0.03 | 3 | 1 | 1 | 81 | 4 | 60 | 2830 |
| Example 2 | 5 | 15~20 | 10 | 3 | 15 | 1 | 1 | 81 | 4 | 60 | 2680 |
| Control 1 | 0.5 | 2~3 | 2 | 0.03 | 3 | 1 | 1 | 81 | 4 | 60 | 850 |
| Control 2 | — | 150~200 | 2 | 0.03 | 3 | 1 | 1 | 81 | 4 | 60 | 1060 |
| Control 3 | — | 500~600 | 2 | 0.03 | 3 | 1 | 1 | 81 | 4 | 60 | 880 |
| Control 4 | 5 | 15~20 | 0.2 | 0.01 | 0.3 | 1 | 1 | 81 | 4 | 60 | 1380 |
| Control 5 | 5 | 15~20 | 25 | 3 | 38 | 1 | 1 | 81 | 4 | 60 | 1710 |
| Control 6 | 5 | 15~20 | 50 | 4 | 75 | 1 | 1 | 81 | 4 | 60 | 1620 |
| Control 7 | 5 | 15~20 | 80 | 6.4 | 120 | 1 | 1 | 81 | 4 | 60 | 1140 |

*Subjected to physical surface roughening.

TABLE 1-2

| | Surface roughening | | Titanium oxide coating 2 | | | | Oxide mixture layer 3 | | Catalyst layer 5 | | Time |
|---|---|---|---|---|---|---|---|---|---|---|---|
| | | | Titanium oxide layer 2a | | | Thickness of titanium | | Ta oxide | | Ir oxide | elapsed |
| | Immersion time (hr) | Surface roughness (Rz: μm) | Potential (V) | Quantity of electricity (mAh/cm²) | Thickness (nm) | oxide layer 2b (μm) | Thickness (μm) | content (Ta-reduced chemical equivalent: mole %) | Thickness (μm) | content (Ir-reduced chemical equivalent: mole %) | before voltage rise to 10 V (hr) |
| Control 8 | 5 | 15~20 | 2 | 0.03 | 3 | 1 | 1 | 10 | 4 | 60 | 830 |
| Control 9 | 5 | 15~20 | 2 | 0.03 | 3 | 1 | 1 | 30 | 4 | 60 | 850 |
| Control 10 | 5 | 15~20 | 2 | 0.03 | 3 | 1 | 1 | 98 | 4 | 60 | 1410 |
| Control 11 | 5 | 15~20 | 2 | 0.03 | 3 | 1 | 1 | 81 | 4 | 10 | 1170 |
| Control 12 | 5 | 15~20 | 2 | 0.03 | 3 | 1 | 1 | 81 | 4 | 30 | 1290 |
| Control 13 | 5 | 15~20 | 2 | 0.03 | 3 | 1 | 1 | 81 | 4 | 98 | 680 |
| Control 14 | 5 | 15~20 | 2 | 0.03 | 3 | 1 | (50 nm) | 81 | 4 | 60 | 1670 |
| Control 15 | 5 | 15~20 | 2 | 0.03 | 3 | 1 | 20 | 81 | 4 | 60 | 920 |
| Control 16 | 5 | 15~20 | 2 | 0.03 | 3 | 1 | 50 | 81 | 4 | 60 | 850 |

EXAMPLES 3 AND 4 AND CONTROLS 17 TO 26

The second electrodes were produced in the following manner:

One hundred ml of solution was prepared by dissolving 1 g of tantalum penta-n-butoxide in n-butyl alcohol.

A titanium oxide layer 2a was formed on the surface of each Ti plate identical to that used in Example 1, under the conditions shown in Table 2, and a titanium oxide layer 2b was formed on the layer 2a under the same conditions as used in Example 1, thereby forming a titanium oxide coating 2. The above solution was applied to each of the titanium oxide layers 2b with a brush, and the solution applied was dried at a temperature of 120° C. for three minutes and then further heated in the air at a temperature of 450° C. for 10 minutes, thereby forming a tantalum oxide layer 4.

Subsequently, a catalyst layer 5 was formed on each of the oxide layers 4 in the same manner as in Example 1.

In Controls 24, 25 and 26, solutions respectively identical to those used in Controls 11, 12 and 13 were used to form the catalyst layers.

For each of the electrodes thus obtained, a voltage application test identical to that employed in Example 1 was conducted to measure the period of time elapsed before the terminal voltage exceeded 10 V. The results are shown in Table 2.

TABLE 2

| | Surface roughening | | Titanium oxide coating 2 | | | | Catalyst layer 5 | | | Time |
|---|---|---|---|---|---|---|---|---|---|---|
| | | | Titanium oxide layer 2a | | | Thickness of titanium | | | Ir oxide | elapsed |
| | Immersion time (hr) | Surface roughness (Rz: μm) | Potential (V) | Quantity of electricity (mAh/cm²) | Thickness (nm) | oxide layer 2b (μm) | Thickness of oxide layer 4 (μm) | Thickness (μm) | content (Ir-reduced chemical equivalent: mole %) | before voltage rise to 10 V (hr) |
| Example 3 | 5 | 15~20 | 2 | 0.03 | 3 | 1 | 0.02 | 4 | 60 | 2520 |
| Example 4 | 5 | 15~20 | 10 | 3 | 15 | 1 | 0.02 | 4 | 60 | 2400 |
| Control 17 | 0.5 | 2~3 | 2 | 0.03 | 3 | 1 | 0.02 | 4 | 60 | 570 |
| Control 18* | — | 150~200* | 2 | 0.03 | 3 | 1 | 0.02 | 4 | 60 | 800 |
| Control 19* | — | 500~600* | 2 | 0.03 | 3 | 1 | 0.02 | 4 | 60 | 670 |
| Control 20 | 5 | 15~20 | 0.2 | 0.01 | 0.3 | 1 | 0.02 | 4 | 60 | 1250 |
| Control 21 | 5 | 15~20 | 25 | 3 | 38 | 1 | 0.02 | 4 | 60 | 1570 |
| Control 22 | 5 | 15~20 | 50 | 4 | 75 | 1 | 0.02 | 4 | 60 | 1410 |
| Control 23 | 5 | 15~20 | 80 | 6.4 | 120 | 1 | 0.02 | 4 | 60 | 1010 |
| Control 24 | 5 | 15~20 | 2 | 0.03 | 3 | 1 | 0.02 | 4 | 10 | 870 |
| Control 25 | 5 | 15~20 | 2 | 0.03 | 3 | 1 | 0.02 | 4 | 30 | 980 |
| Control 26 | 5 | 15~20 | 2 | 0.03 | 3 | 1 | 0.02 | 4 | 98 | 500 |

*Subjected to the same physical surface roughening as used in Control 2.

EXAMPLES 5 AND 6 AND CONTROLS 27 TO 42

The third electrodes were produced in the following manner:

A titanium oxide layer 2a was formed on each of Ti plates identical to that used in Example 1, by surface toughening and electrolytic oxidation under the conditions shown in Table 3-1 and Table 3-2, and then a titanium oxide layer 2b was formed by a thermal decomposition method under the same conditions as used in Example 1.

Subsequently, a Ta oxide layer 4 was formed on each titanium oxide layer 2b under the same conditions as used in Example 3, and an oxide mixture layer 3 was formed on the layer 4 under the same conditions as used in Example 1.

Finally, a catalyst layer 5 was formed on each of the oxide mixture layers 3 in the same manner as in Example 1.

For each of the electrodes thus obtained, a voltage application test identical to that employed in Example 1 was conducted to measure the period of time elapsed before the terminal voltage exceeded 10 V. The results are shown in Table 3-1 and Table 3-2.

TABLE 3-1

| | Surface roughening | | Titanium oxide coating 2 | | | | | Oxide mixture layer 3 | | Catalyst layer 5 | | Time |
|---|---|---|---|---|---|---|---|---|---|---|---|---|
| | | | Titanium oxide layer 2a | | | Thickness of titanium | Thickness | | Ta oxide content | | Ir oxide content | elapsed before voltage |
| | Immersion time (hr) | Surface roughness (Rz: μm) | Potential (V) | Quantity of electricity (mAh/cm$^2$) | Thickness (nm) | oxide layer 2b (μm) | of oxide layer 4 (μm) | Thickness (μm) | (Ta-reduced chemical equivalent: mole %) | Thickness (μm) | (Ir-reduced chemical equivalent: mole %) | rise to 10 V (hr) |
| Example 5 | 5 | 15~20 | 2 | 0.03 | 3 | 1 | 0.02 | 1 | 81 | 4 | 60 | 2940 |
| Example 6 | 5 | 15~20 | 10 | 3 | 15 | 1 | 0.02 | 1 | 81 | 4 | 60 | 2790 |
| Control 27 | 0.5 | 2~3 | 2 | 0.03 | 3 | 1 | 0.02 | 1 | 81 | 4 | 60 | 940 |
| Control 28* | — | 150~200 | 2 | 0.03 | 3 | 1 | 0.02 | 1 | 81 | 4 | 60 | 1130 |
| Control 29* | — | 500~600 | 2 | 0.03 | 3 | 1 | 0.02 | 1 | 81 | 4 | 60 | 960 |
| Control 30 | 5 | 15~20 | 0.2 | 0.01 | 0.3 | 1 | 0.02 | 1 | 81 | 4 | 60 | 1500 |
| Control 31 | 5 | 15~20 | 25 | 3 | 38 | 1 | 0.02 | 1 | 81 | 4 | 60 | 1830 |
| Control 32 | 5 | 15~20 | 50 | 4 | 75 | 1 | 0.02 | 1 | 81 | 4 | 60 | 1720 |
| Control 33 | 5 | 15~20 | 80 | 6.4 | 120 | 1 | 0.02 | 1 | 81 | 4 | 60 | 1240 |

*Subjected to the same physical surface roughening as used in Control 3.

TABLE 3-2

| | Surface roughening | | Titanium oxide coating 2 | | | | | Oxide mixture layer 3 | | Catalyst layer 5 | | Time |
|---|---|---|---|---|---|---|---|---|---|---|---|---|
| | | | Titanium oxide layer 2a | | | Thickness of titanium | Thickness | | Ta oxide content | | Ir oxide content | elapsed before voltage |
| | Immersion time (hr) | Surface roughness (Rz: μm) | Potential (V) | Quantity of electricity (mAh/cm$^2$) | Thickness (nm) | oxide layer 2b (μm) | of oxide layer 4 (μm) | Thickness (μm) | (Ta-reduced chemical equivalent: mole %) | Thickness (μm) | (Ir-reduced chemical equivalent: mole %) | rise to 10 V (hr) |
| Control 34 | 5 | 15~20 | 2 | 0.03 | 3 | 1 | 0.02 | 1 | 10 | 4 | 60 | 910 |
| Control 35 | 5 | 15~20 | 2 | 0.02 | 3 | 1 | 0.02 | 1 | 30 | 4 | 60 | 980 |
| Control 36 | 5 | 15~20 | 2 | 0.03 | 3 | 1 | 0.02 | 1 | 98 | 4 | 60 | 1520 |
| Control 37 | 5 | 15~20 | 2 | 0.03 | 3 | 1 | 0.02 | 1 | 81 | 4 | 10 | 1200 |
| Control 38 | 5 | 15~20 | 2 | 0.03 | 3 | 1 | 0.02 | 1 | 81 | 4 | 30 | 1310 |
| Control 39 | 5 | 15~20 | 2 | 0.03 | 3 | 1 | 0.02 | 1 | 81 | 4 | 98 | 720 |
| Control 40 | 5 | 15~20 | 2 | 0.03 | 3 | 1 | 0.02 | (50 nm) | 81 | 4 | 60 | 1780 |
| Control 41 | 5 | 15~20 | 2 | 0.03 | 3 | 1 | 0.02 | 20 | 81 | 4 | 60 | 1000 |
| Control 42 | 5 | 15~20 | 2 | 0.03 | 3 | 1 | 0.02 | 50 | 81 | 4 | 60 | 960 |

CONTROLS 43 TO 45

A solution for the catalyst layer identical to that used in Example 1 was applied directly to the surface of a Ti plate which had been subjected to the same surface roughening as employed in Example 1. The solution applied was dried at a temperature of 120° C. for three minutes, and then further heated in the air at a temperature of 450° C. for 10 minutes, thereby thermally decomposing the substances of the solution to obtain an oxide mixture layer. The operation consisting of the solution application step, the drying step, and the thermal decomposition step was repeated four times, thereby forming a catalyst layer having a thickness of about 4 μm (Control 43).

A titanium oxide layer 2b was formed directly on the surface of a Ti plate which had been subjected to the same surface roughening as employed in Example 1, by the thermal decomposition method under the same conditions as used in Example 1. Then, a catalyst layer was formed on the layer 2b under the same conditions as used in Example 1 (Control 44).

A 100-ml solution prepared by dissolving 17.0 g of titanium n-butoxide and 27.3 g of tantalum penta-n-butoxide in n-butyl alcohol was applied to the surface of a Ti plate which had been subjected to the same surface roughening as employed in Example 1. The solution applied was dried at a temperature of 120° C. for three minutes, and then further heated for thermal decomposition in the air at a temperature of 450° C. for 10 minutes. The operation consisting of the solution application step, the drying step, and the thermal decomposition step was repeated twice, thereby forming an oxide mixture layer consisting of Ti oxide and Ta oxide and having a thickness of about 1 μm. The ratio at which the Ti oxide was contained in the oxide mixture layer, measured in terms of Ti (metal)-reduced chemical equivalent, was approximately 50 mole %.

Subsequently, a catalyst layer identical to that of Example 1 was formed on the oxide mixture layer (Control 45).

For each of the above three electrodes, a voltage application test identical to that employed in Example 1 was conducted to measure the period of time elapsed before the terminal voltage exceeded 10 V. In Controls 43, 44 and 45, the measured time periods were 180 hours, 890 hours, and 720 hours, respectively.

What is claimed is:

1. A method of producing an oxygen generating electrode, comprising the steps of:

preparing a base material having at least a surface thereof made of titanium alone or a titanium alloy;

forming a primary coating on the surface of the base material; and forming a catalyst layer on the primary coating, the catalyst layer containing an oxide of a platinum group element as a main component, and wherein said primary coating is composed of (1) a titanium oxide coating and an oxide mixture layer, wherein (a) the titanium oxide coating is made of a titanium oxide only and includes a first titanium oxide layer formed by electrolytically oxidizing the surface of the base material in an electrolyte solution to which no titanium ions have been provided, and a second titanium oxide layer formed on the first titanium oxide layer by a thermal decomposition method which involves applying a solution containing a titanium compound to the electrolytically prepared oxide layer, and (b) the oxide mixture layer includes at least one layer formed on the titanium oxide coating and consists of a mixture containing an oxide of an element belonging to a group other than the platinum group, as a main component, and an oxide of a platinum group element, or (2) a titanium oxide coating and an oxide layer, wherein (a) the titanium oxide coating is made of a titanium oxide only and includes a first titanium oxide layer formed by electrolytically oxidizing the surface of the base material in an electrolyte solution to which no titanium ions have been provided, and a second titanium oxide layer formed on the first titanium oxide layer by a thermal decomposition method which involves applying a solution containing a titanium compound to the electrolytically prepared oxide layer, and (b) the oxide layer is formed on the titanium oxide coating and consists of an oxide of an element belonging to a group other than the platinum group, or (3) a titanium oxide coating, an oxide layer and an oxide mixture layer, wherein (a) the titanium oxide coating is made of a titanium oxide only and includes a first titanium oxide layer formed by electrolytically oxidizing the surface of the base material and a second titanium oxide layer formed on the first titanium oxide layer by a thermal decomposition method, (b) the oxide layer is formed on the second titanium oxide layer and consists of a single oxide of an element belonging to a group other than the platinum group, and (c) the oxide mixture layer is formed on the oxide layer and consists of an oxide of an element belonging to a group other than the platinum group, the oxide mixture layer including at least one layer wherein the layer or layers consist of a mixture containing an oxide of an element belonging to a group other than the platinum group, as a main component, and an oxide of a platinum group element; and said first titanium oxide layer is formed by immersing the base material in an electrolyte, and then carrying out an electrolytic oxidation process using a quantity of electricity of 3 mAh/cm$^2$ or less at a potential of 0.5 to 15 V with respect to the normal hydrogen electrode potential, thereby forming a layer of a titanium oxide having a thickness of 1 to 20 nm on the surface of the base material.

2. The method according to claim 1, wherein said oxide mixture layer consists of a mixture of a tantalum oxide and an iridium oxide and has a thickness of 0.1 to 10 μm.

3. The method according to claim 2, wherein said oxide mixture layer has a thickness of 1 to 5 μm.

4. The method according to claim 2, wherein a proportion of the tantalum oxide in said oxide mixture layer is 50 to 95 mole % in terms of tantalum metal-reduced chemical equivalent.

5. The method according to claim 1, wherein the electrolytic oxidation process is carried out at a potential of 1.5 to 3 V with respect to the normal hydrogen potential.

6. The method according to claim 1, wherein the first titanium oxide layer formed by the electrolytic oxidation process has a thickness of 2 to 5 nm.

7. The method according to any one of claims 1, 5 and 6, wherein removal of a titanium oxide skin film from the surface of the base material and surface roughening of the base material are carried out before the base material is immersed in the electrolyte.

8. The method according to claim 7, wherein the removal of the titanium oxide skin film and the surface roughening are carried out by electrolytic etching using a solution of oxalic acid.

9. A method of producing an oxygen generating electrode, comprising the steps of:

preparing a base material having at least a surface thereof made of titanium alone or a titanium alloy with a roughness of 5 to 100 μm according to surface roughness ($R_z$) measured by JIS B0601;

forming a primary coating on the surface of the base material; and forming a catalyst layer on the primary coating, the catalyst layer containing an oxide of a platinum group element as a main component, and wherein said primary coating is composed of (1) a titanium oxide coating and an oxide mixture layer, wherein (a) the titanium oxide coating is made of a titanium oxide only and includes a first titanium oxide layer formed by electrolytically oxidizing the surface of the base material in an electrolyte solution to which no titanium ions have been provided, and a second titanium oxide layer formed on the first titanium oxide layer by a thermal decomposition method which involves applying a solution containing a titanium compound to the electrolytically prepared oxide layer, and (b) the oxide mixture layer includes at least one layer formed on the titanium oxide coating; consists of a mixture of tantalum oxide and iridium oxide; and has a thickness of 0.1 to 10 μm; the proportion of tantalum oxide of the oxide mixture is 50 to 90 mole % in terms of tantalum metal-reduced chemical equivalent, or (2) a titanium oxide coating and an oxide layer, wherein (a) the titanium oxide coating is made of a titanium oxide only and includes a first titanium oxide layer formed by electrolytically oxidizing the surface of the base material in an electrolyte solution to which no titanium ions have been provided, and a second titanium oxide layer formed on the first titanium oxide layer by a thermal decomposition method which involves applying a solution containing a titanium compound to the electrolytically prepared oxide layer, and (b) the oxide layer is formed on the titanium oxide coating and consists of tantalum oxide, or (3) a titanium oxide coating, an oxide layer and an oxide mixture layer, wherein (a) the titanium oxide coating is made of a titanium oxide only and includes a first titanium oxide layer formed by electrolytically oxidizing the surface of the base material in an electrolyte solution to which no titanium ions have been provided, and a second titanium oxide layer formed on the first titanium oxide layer by a thermal decomposition method which involves applying a solution containing a titanium compound to the electrolytically prepared oxide layer, and (b) the oxide mixture layer is formed on the titanium oxide coating and consists of tantalum oxide, the oxide mixture layer including at least one layer formed on the oxide layer and consisting of a mixture of tantalum oxide and iridium oxide, and having a thickness of 0.1 to 10 μm; the proportion of tantalum oxide of the oxide mixture is 50 to 90 moles % in terms of tantalum metal-reduced chemical equivalent; and said first titanium oxide layer is formed by immersing the base material in an electrolyte, and then carrying out an electrolytic oxidation process using a quantity of electricity of 3 $mAh/cm^2$ or less at a potential of 0.5 to 15 V with respect to the normal hydrogen electrode potential, thereby forming a layer of a titanium oxide having a thickness of 1 to 20 nm on the surface of the base material.

* * * * *